United States Patent [19]

Preston et al.

[11] 4,299,379

[45] Nov. 10, 1981

[54] MOVING CARRIAGE BUFFER/FEEDER

[75] Inventors: William C. Preston, Richardson; Michael W. Still, Dallas, both of Tex.

[73] Assignee: E-Systems, Inc., Dallas, Tex.

[21] Appl. No.: 122,510

[22] Filed: Feb. 19, 1980

Related U.S. Application Data

[63] Continuation of Ser. No. 880,018, Feb. 21, 1978, abandoned.

[51] Int. Cl.[3] ..... B65H 1/02; B65H 1/08; B65H 3/04; B65H 1/30

[52] U.S. Cl. ..... 271/3.1; 271/34; 271/149; 271/215

[58] Field of Search ..... 271/3.1, 149, 150, 34, 271/35, 30 A, 129, 214, 215; 414/103

[56] References Cited

U.S. PATENT DOCUMENTS

| | | | |
|---|---|---|---|
| 3,051,333 | 8/1962 | Richert et al. | 414/103 |
| 3,193,280 | 7/1965 | Gutierrez | 271/2 |
| 3,285,389 | 11/1966 | Kaplan | 271/150 X |
| 3,347,348 | 10/1967 | Flint et al. | 198/454 |
| 3,511,368 | 5/1970 | Kajitani | 271/34 X |
| 3,647,203 | 3/1972 | DeHart | 271/149 X |
| 3,682,473 | 8/1972 | Kuyt | 271/149 X |
| 3,690,474 | 9/1972 | Klappenecker | 414/103 |
| 3,770,265 | 11/1973 | Gatti | 271/34 X |
| 3,817,516 | 6/1974 | Lazzarotti et al. | 271/150 |
| 3,944,211 | 3/1976 | Rasmussen et al. | 271/34 X |

*Primary Examiner*—Bruce H. Stoner, Jr.

*Attorney, Agent, or Firm*—Robert V. Wilder; Albert M. Crowder, Jr.

[57] ABSTRACT

A device for transporting and buffering a flow of small articles, such as mail pieces, includes a conveyor belt that moves the articles onto a linearly displaceable carriage which delivers the articles into a buffer stack at a constant entrance angle regardless of buffer stack size. Articles in the buffer stack are supported and agitated by a plurality of rotating beater bars. Agitation causes skewed articles to level while the rotation of the beater bars transports the articles toward a moving edging belt that propels them into a feeder output. One of the plurality of beater bars includes screw thread sections for advancing the articles toward the feeder output.

10 Claims, 9 Drawing Figures

MOVING CARRIAGE BUFFER/FEEDER

This is a continuation of application Ser. No. 880,018 filed Feb. 21, 1978, now abandoned.

BACKGROUND OF THE INVENTION

The present invention relates to an article conveying device, and more particularly to such a conveying device having a moving carriage and a buffer storage.

In the handling of mail it is necessary that each item be individually canceled and this process requires that the items be correctly oriented. Since large post offices must handle hundreds of thousands of letters per day, the canceling machinery must have an extremely high throughput rate, but the rate is significantly reduced if the machine must be frequently stopped to remove jammed or nonlevel, that is, skewed, items. Canceling machines generally are designed to operate at a constant rate, therefore, it is necessary that they be supplied with a uniform rate of input items. However, the feeder machinery that transfers the bulk mail into the canceler generally does not work at a uniform rate but at a rate that varies over short time periods. Therefore, there is a need for a device to interface mail feeding machinery with canceling machines to level the skewed mail, generate an output of single, nonoverlapping items, and provide a uniform output rate despite variations in the rate of input.

A stacking device directed to the above problem is that shown in U.S. Pat. No. 3,690,474 issued to Klappenecker. This device forms a buffer stack of articles which are transported over a moving carriage fed by a conveyor belt. This device, however, does not provide any means for leveling skewed mail.

Additional article handling devices are shown in U.S. Pat. No. 3,193,280 to Gutierrez, 3,511,368 to Kajitani and 3,347,348 to Flint et al.

SUMMARY OF THE INVENTION

In accordance with the present invention there is provided an interface device for transporting and buffering bulk articles, such as mail, from an input machine to a feeder output that supplies articles to a canceling machine. The device includes a supporting frame, a linearly movable carriage, and a conveyor belt which transports the articles from the input machine over the movable carriage into a buffer stack. An edging belt advances articles in the buffer stack toward the feeder output while rotating beater bars having flat sides agitate the mail articles to level them and transport them toward the edging belt. Further, rotating beater bars with screw thread sections urge the mail articles toward the feeder output and toward the edging belt as well as providing additional agitation.

BRIEF DESCRIPTION OF THE DRAWINGS

For a more complete understanding of the present invention and the advantages thereof, reference is now made to the following description taken into conjunction with the accompanying drawings, in which.

DESCRIPTION OF THE PREFERRED EMBODIMENT

Figure 1:
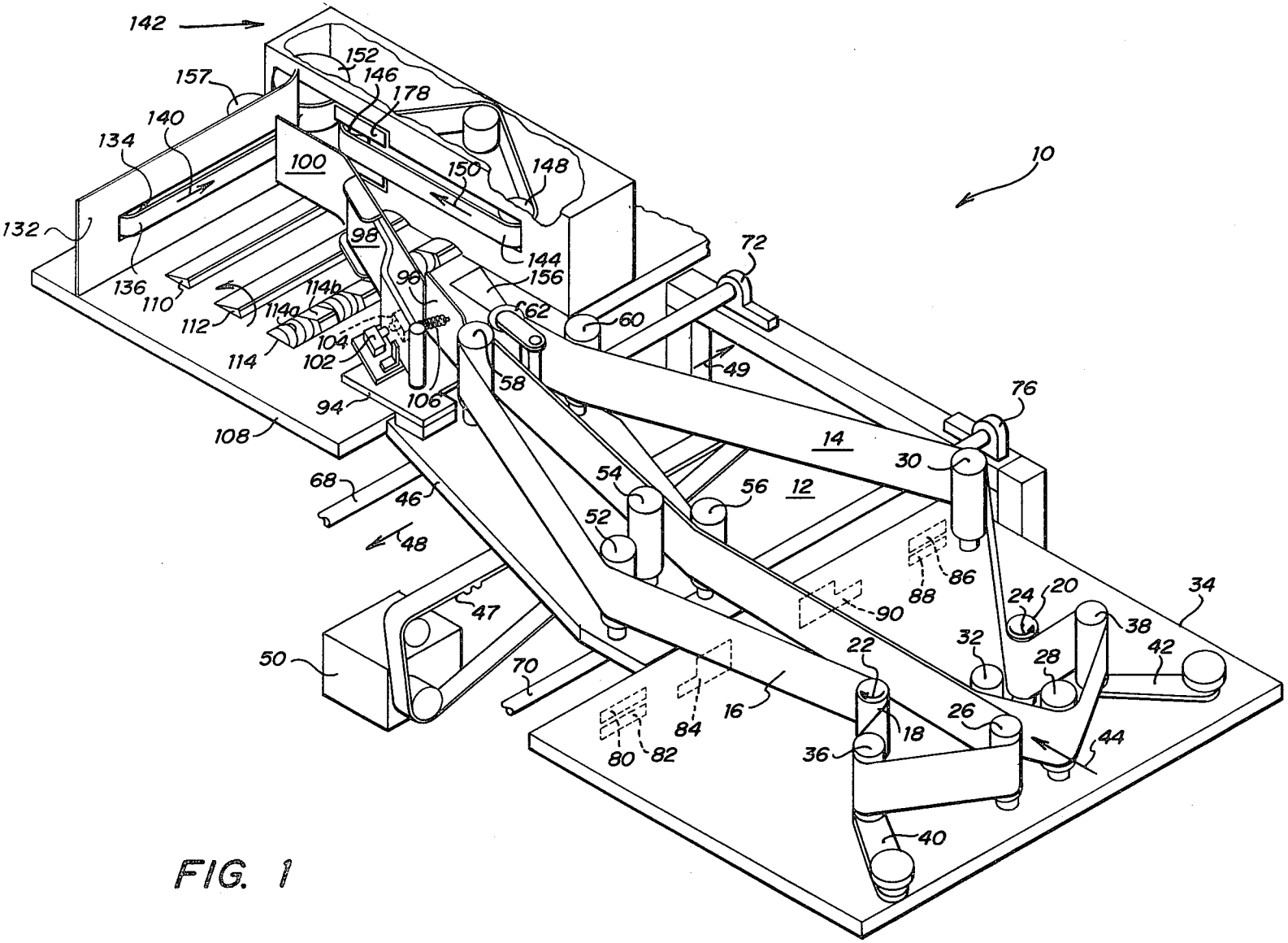
FIG. 1 is a perspective view of a moving carriage buffer/feeder in accordance with the present invention.

A moving carriage buffer/feeder 10 in accordance with the present invention is shown in FIG. 1. Articles are provided from a bulk feeder device (not shown) such as an M-500 Edger-Feeder which is in routine use by the United States Postal Service. The articles are input to a conveyor belt system 12 that comprises a first belt 14 and a second belt 16. Belts 14 and 16 are driven by drive rollers 18 and 20 which rotate in the direction shown by the arrows 22 and 24 respectively. Drive rollers 18 and 20, along with fixed rollers 26, 28, and 30 and 32, are supported on a base plate 34. Tension rollers 36 and 38 are supported respectively by spring loaded pivot members 40 and 42. Thus, in accordance with the drive of the belts 14 and 16, articles inserted between rollers 26 and 28 are pinched between the belts and carried along by them in the direction of the arrow 44.

Figure 2:
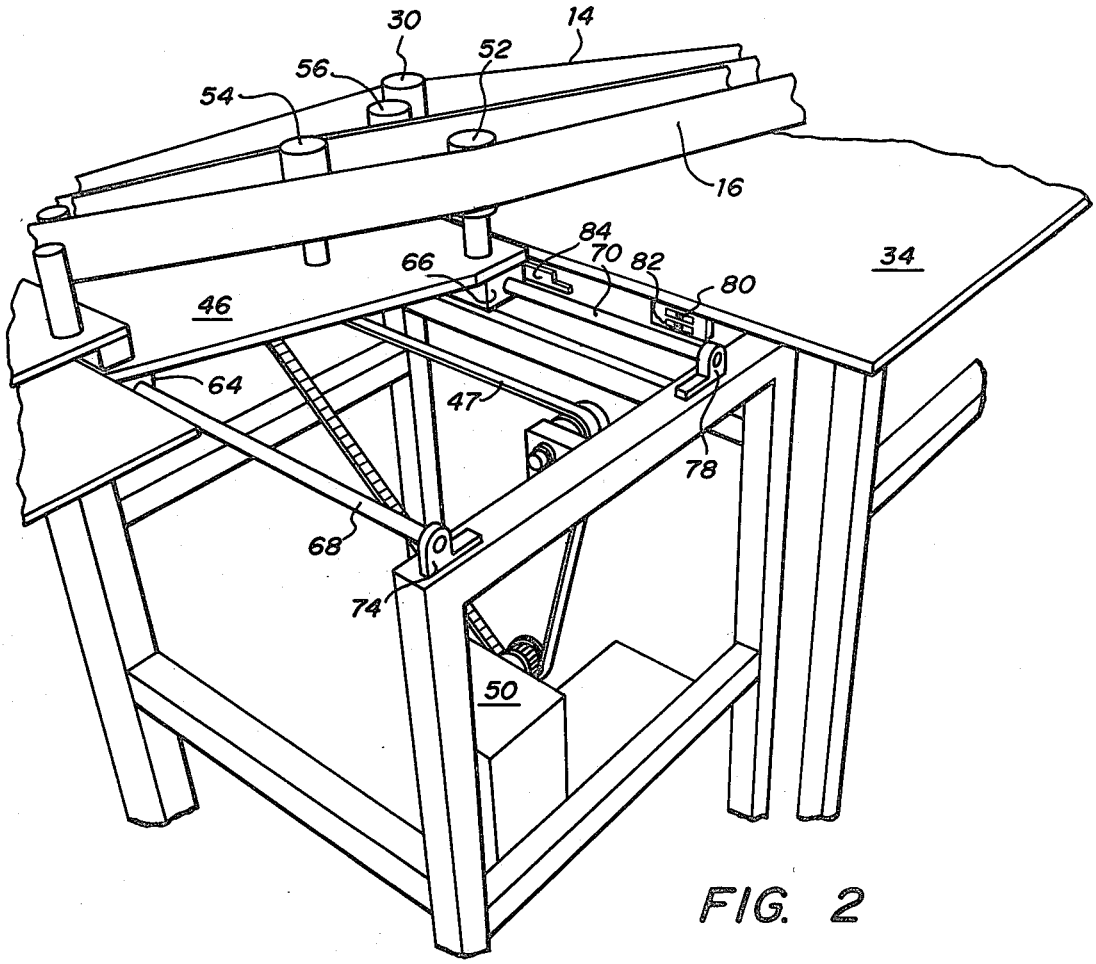
FIG. 2 is a perspective view of the moving carriage and support mechanism of the present invention.

Belts 14 and 16 extend from the base plate 34 to a moving carriage 46 which is linearly displaced by a belt 47 that is driven by a motor 50. Additional features of the moving carriage 46 are shown in FIG. 2. Motor 50 can displace the moving carriage 46 in either of the directions shown by arrows 48 and 49. Belt 47 is joined to the bottom surface of the moving carriage 46. Fixed rollers 52, 54, 56, 58, and 60 are mounted on the moving carriage 46 to support the belts 14 and 16. A pinch roller 62 is mounted on the moving carriage 46 opposite the fixed roller 58 in order to press together the belts 14 and 16.

The moving carriage 46 has a pair of sliding mounts 64 and 66 disposed respectively on rods 68 and 70. Rod 68 is supported by bearing mounts 72 and 74 while rod 70 is supported by bearing mounts 76 and 78.

Disposed along the bottom edge of the base plate 34 are a first pair of microswitches 80 and 82 which are actuated by the plate 84 mounted on the moving carriage 46. The lower extension of plate 84 activates microswitch 82 and the upper portion of plate 84 activates microswitch 80. Microswitchs 86 and 88 are disposed on the bottom edge of base plate 34 and are similarly actuated by a plate 90 mounted on the opposite side of the moving carriage 46 from the plate 84.

Articles input at the fixed rollers 26 and 28 between the belts 14 and 16 are carried along from the base plate 34 to the moving carriage 46, between the fixed rollers 54 and 56, and then released from the belts after passing between rollers 58 and 62.

Figure 3:
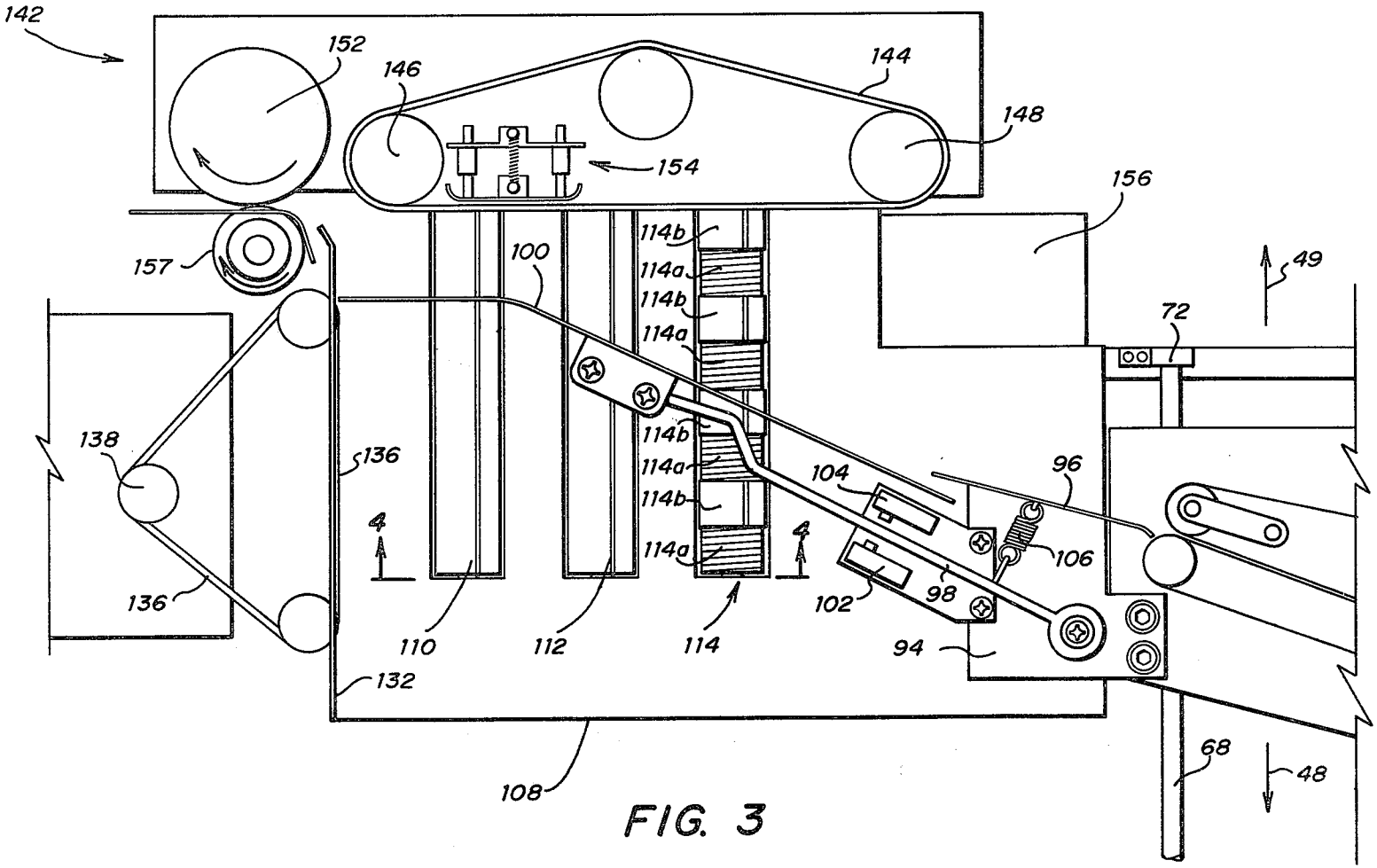
FIG. 3 is a plan view of the buffer stack section of the present invention.

The moving carriage buffer/feeder 10 is further described in reference to FIGS. 1 and 3. Attached to the moving carriage 46 is an extension plate 94. Mounted on the extension plate 94 are an overlap plate 96, a pivoting arm 98 carrying a shoe 100, and a pair of microswitches 102 and 104. A spring 106 tensions the pivoting arm 98 along with the shoe 100.

The shoe 100 is located over a base plate 108 which has disposed therethrough a pair of flat-sided beater bars 110 and 112. A segmented beater bar 114 is parallel to the beater bars 110 and 112 and comprises alternating sections of screw threads 114*a* and flat sides 114*b*.

Figure 4:
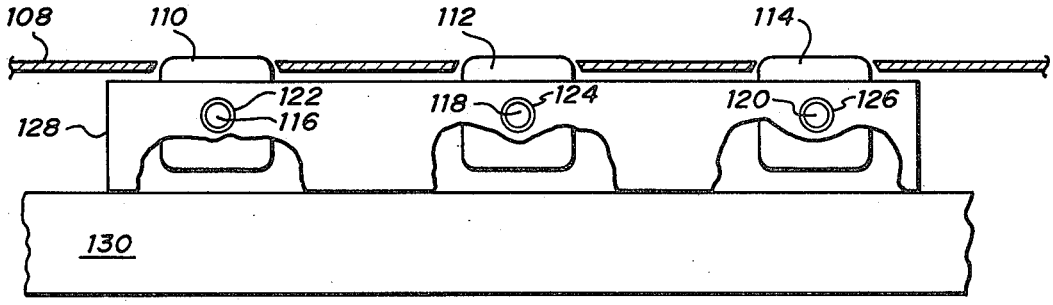
FIG. 4 is a cross section view taken along lines 4—4 of FIG. 3 and showing beater bars and supporting structure of the present invention.

Beater bars 110, 112, and 114 are further illustrated in FIG. 4. Shafts 116, 118 and 120 are centered respectively in the beater bars 110, 112 and 114 and are supported by bearings 122, 124 and 126. The bearings are disposed in the frame member 128 which is in turn supported by a frame member 130. Slots in the base plate 108 allow the beater bars to have the uppermost portions disposed above the upper surface of the base plate 108. The articles handled by the moving carriage buffer/feeder are thus supported by the beater bars rather than the base plate 108. A similar structure supports the opposite ends of the shafts 116, 118 and 120.

Figure 5:
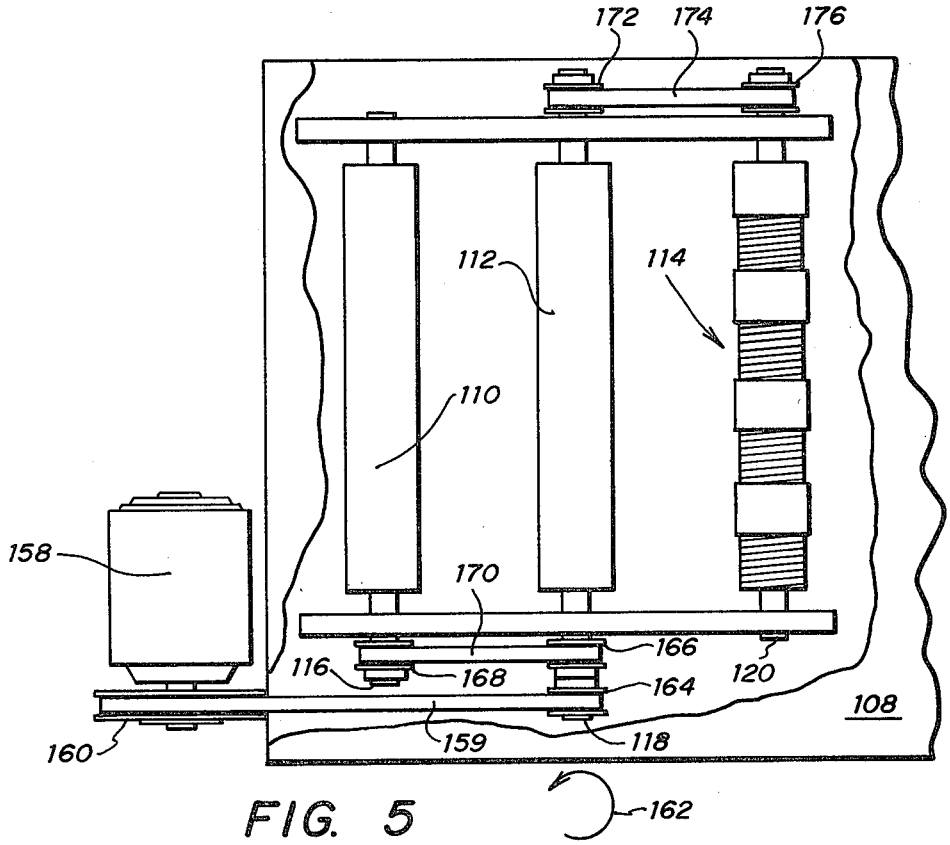
FIG. 5 is an elevation view of the beater bar drive mechanism.

The drive mechanism for the beater bars 110, 112 and 114 is illustrated in FIG. 5. A motor 158 drives a belt 159 by means of a pulley 160. A pulley 164 on shaft 118 is driven in the direction of arrow 162 by the belt 159. A second pulley 166 on the shaft 118 drives a pulley 168 on shaft 116 by means of a belt 170. A third pulley 172 on shaft 118 drives a belt 174 that rotates a pulley 176 on shaft 120. Thus, all three of the beater bars rotate in the same direction.

Referring to FIGS. 1 and 3, an edging fence 132 joined vertically to the base plate 108 has a horizontal slot 134 disposed therein. An edging belt 136 passes through the slot 134, is driven by a pulley 138, and moves in the direction shown by the arrow 140. The edging belt 136 is displaced 0.030–0.040 inch above the surface of the edging fence 132.

An output feeder 142, also located on the base plate 108, comprises a feeder belt 144 moving on rollers 146 and 148 in the direction of arrow 150, a roller 152, and a stop feed assembly 154. Disposed in the base plate 108 in front of the output feeder 142 is a fallout trough 156. A stripper wheel 157 is disposed adjacent the roller 152.

Figure 6:
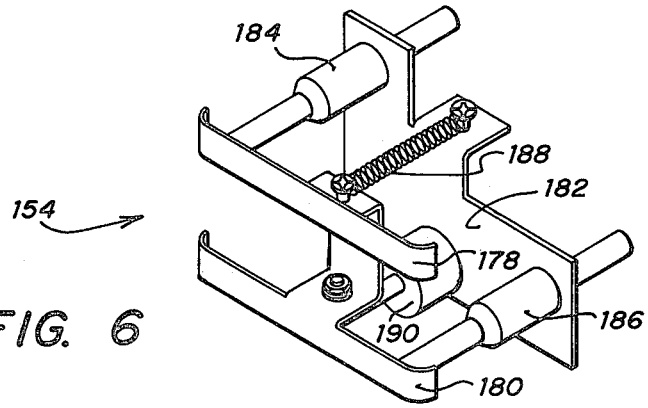
FIG. 6 is a perspective view of the stop feed shoe and solenoid.

The stop feed assembly 154 is illustrated in FIG. 6. Shoe plates 178 and 180 are horizontally disposed and joined to a support plate 182 by guide bars 184 and 186, spring 188, and solenoid 190. Upon activation of the solenoid 190 the shoe plates 178 and 180 are projected forward against the tension of the spring 188. When solenoid 190 is deactivated, the shoe plates 178 and 180 are retracted by the spring 188.

Figure 7:
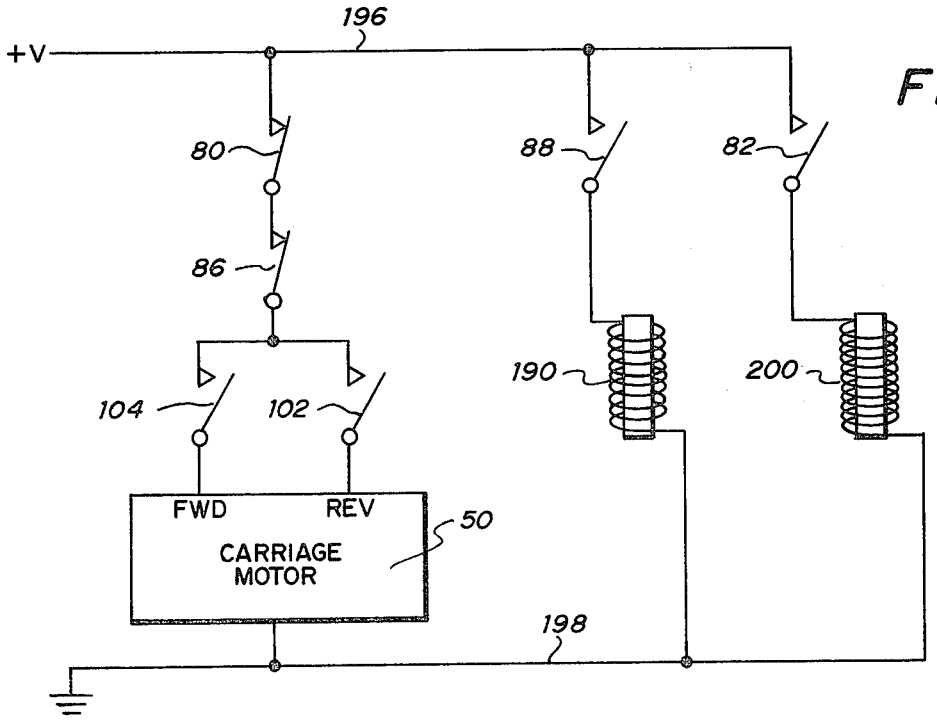
FIG. 7 is a schematic diagram of the electrical system of the present invention.

An electrical schematic for the moving carriage buffer/feeder 10 is shown in FIG. 7. The electrical components are driven by a power bus 196 and joined by a common ground 198. Microswitches 80 and 86 (normally closed) are connected in series with the directional drive microswitches 102 and 104 (normally open) which drive the motor 50 in the forward and reverse directions respectively. Microswitch 88 (normally open) is connected in series with the stop feed solenoid 190. The microswitch 82 (normally open) is connected in series with a bulk feeder disable solenoid 200.

Referring to FIGS. 1 and 3, in operation, mail articles are fed into the moving carriage buffer/feeder 10 between the rollers 26 and 28 and are carried by the belts 14 and 16 onto the moving carriage 46. In one embodiment of the invention, the belts 14 and 16 are driven at a speed of 110 inches per second. The mail articles are released from the belts after passing between the rollers 58 and 62 whereupon they are carried by their momentum and by the flat side beater bars 110 and 112 and the segmented beater bar 114 until the leading edge of the mail article touches the edging belt 136. As a number of articles are passed through the belts 14 and 16, a buffer stack of articles is accumulated between the shoe 100 and the output feeder 142. The articles enter the buffer stack at an angle of 20–25 degrees relative to the articles already in the buffer stack. While in the stack, the articles are held vertically in position by the shoe 100 which is set to maintain a constant pressure on the buffer stack. The lead article in the buffer stack, which is in contact with the output feeder 142, is carried by the feeder belt 144 and roller 152 from the buffer stack in the direction of the arrow 150 and into a canceling machine (not shown). Stripper wheel 157 rotates against the flow of articles to prevent the output of multiple articles simultaneously.

A problem which frequently arises in the operation of automatic mail handling equipment is that articles output by the bulk feeder into the conveyor belt are not level but are skewed at some angle. The processing machine, such as a canceler cannot efficiently handle such an item. Therefore, in accordance with the present invention, there is provided a method for leveling skewed articles.

The articles in the buffer stack are supported by the beater bars 110, 112, and 114. These bars rotate in such a direction as to carry the articles toward the edging belt 136. Beater bars 110 and 112 have flat sides which extend the length of the bar and cause the articles in the buffer stack to be agitated vertically as the bars rotate. Similar agitation is caused by the flat sections 114*b* of the segmented beater bar 114. The vertical agitation of the articles tends to shake any skewed article and cause it to drop down into the level position. To function most effectively the beater bars, see FIG. 4, must be synchronized so that each bar presents a raised surface to the articles in the stack at the same time. The beater bars rotate at the same speed and maintain the same orientation. If the orientation of the bars differ, the articles in the buffer stack receive little agitation. The rotational rate of the bars determines the linear speed of travel of articles over the bars. In one embodiment of the present invention it has been determined that the bars should rotate at a rate to produce a linear article speed of 55 inches per second. With this leveling process, there is a substantially lower percentage of skewed articles fed to the canceling machine, therefore, there are fewer instances of jammed or damaged machinery.

Although the beater bars shown in FIG. 4 have a square cross-section with rounded corners, any non-circular shape will provide agitation and carry-through of articles in the buffer stack. The factors which must be optimized are the frequency of agitation versus the linear article speed. For example, a beater rotating at the same rate as that of the present invention, but with only two raised surfaces, would have the same linear article speed but only half the agitation frequency. Any number of raised surfaces could be used, however, it has been found that a four-sided bar operating at a speed of 55 inches per second provides the optimum performance.

Referring to FIGS. 1 and 3, when functioning properly, the bulk feeder supplies the moving carriage buffer/feeder 10 with a continuous flow of right-hand shingled mail articles. In a shingled article flow each item overlaps both the preceding article and the following article. With a right-hand shingle flow, the leading article is on the right-hand side of the following article. An article will occasionally pass between the rollers 58 and 62 and instead of correctly sliding into the buffer stack between the preceding article and the shoe 100, it will collide with the trailing edge of an article already in the buffer stack. This generally occurs when the bulk feeder transfers a left-hand shingled article into the moving carriage buffer/feeder 10. After the collision the article will tip over due to gravity and fall into the trough 156. These fallover articles will then be carried by the trough 156 to a bin (not shown) for collection and later reprocessing. The width of trough 156 can extend as far as the length of the buffer stack.

The beater bars 110, 112 and 114 apply a continuing force against articles in the buffer stack urging them toward the edging belt 136. When articles are not properly edged, there is created a problem termed doubling. Doubling occurs when the feeder belt contacts two articles simultaneously due to one of the articles not being against the edging belt 136. This condition results in faulty operation and can cause the machine to jam which stops mail processing until an operator manually removes the jammed articles. The constant urging of the articles during the time period they are in the buffer stack properly edges the majority of mail articles to substantially reduce the doubling problem.

The articles in the buffer stack are carried forward to the output feeder 142 and feeder belt 144 by a number of members. The edging belt 136, which is in contact with the leading edge of the articles, carries the articles toward the output feeder 142. In addition, the segmented beater bar 114 has screw-feed sections 114*a* which capture the bottom edges of the articles and tend to force them forward through the buffer stack to the feeder belt 144. Since the articles in the buffer stack are compressed against each other, a force applied against any outer article will tend to force other articles disposed between that article and the feeder belt 144 forward in the buffer stack.

In order for the agitation by the beater bars 110, 112, and 114 to be effective, there must be a slight but constant force applied to the buffer stack. This force is supplied by the edging belt 136 and the segmented beater bar 114 with screw-feed sections 114*a*.

In order to maintain a rapid flow of incoming mail articles to the buffer stack, but without causing the articles to jam or collide with other articles, the entrance angle of the mail articles to the stack should be maintained at a constant angle. This angle is held constant despite changes in the size of the buffer stack by movement of the moving carriage 46. This movement is controlled by the displacement of the shoe 100 by the articles in the buffer stack.

Shoe 100 is mounted on the pivot arm 98 which is disposed between a set of microswitches 102 and 104. The electrical operation of the microswitches and solenoids is shown in FIG. 7. These microswitches are located such that when the force of the articles in the buffer stack on the shoe 100 exceeds a predetermined pressure, which is set in the range of 60–100 grams, the microswitch 102 is actuated, and when the force on the shoe is less than the predetermined value, the microswitch 104 is actuated. These microswitches generate control signals which are supplied to the motor 50 that drives the belt 47 which in turn controls the linear position of the moving carriage 46.

When articles have been input into the buffer stack at a greater rate than they have been output by the output feeder 142, the articles in the stack displace the shoe 100 so as to actuate the microswitch 102. When this microswitch is actuated the motor 50 will cause the moving carriage 46 to travel in the direction of the arrow 48. Since the shoe 100 is supported by the moving carriage 46, the shoe will be transported away from the buffer stack and therefore the pressure against the shoe will be reduced. When the pressure on the shoe 100 by the articles in the buffer stack has been reduced back to the predetermined level, the microswitch 102 will be deactivated and the motor 50 will stop.

When the input rate to the buffer stack has been lower than the output rate, the articles in the buffer stack will be moved forward and the shoe 100 will be displaced toward the feeder output, thus causing the microswitch 104 to be actuated. Actuation of this microswitch will cause the motor 50 to displace the moving carriage 46 in the direction of the arrow 49. This motion will cause the shoe 100 to be transported toward the buffer stack and therefore increase the pressure on the shoe until the microswitch 104 is deactivated. Thus, the entrance angle to the buffer stack is maintained constant despite the size of the buffer stack.

The buffer stack should be maintained at a size greater than a minimum value in order that the mail articles may remain in the buffer stack for a sufficient period of time to be agitated and thereby lower any skewed articles and also to fully transport each article to the edging belt 136. It has been found that a stack length of at least one-half inch provides the period of time in order to properly level and edge the mail articles. When the movable carriage 46 has traveled in the direction of the arrow 49 to the extent that the buffer stack is one-half inch thick, the plate 90 contacts the microswitch 88. Microswitch 88 is connected to the stop feed solenoid 190, which, when activated, moves the shoe plates 178 and 180, shown in FIG. 6, forward to push the buffer stack away from the feeder belt 144. This action terminates the output of articles by the output feeder 142. With continued input of articles the buffer stack grows longer which in turn causes the movable carriage 46 to displace in the direction of arrow 48. When the carriage moves, the microswitch 88 is deactivated which in turn causes the shoe plates 178 and 180 to retract behind the feeder belt 144. This allows mail articles in the buffer stack to again be transported by the output feeder 142.

When the input to the movable carriage buffer/feeder 10 has exceeded the output for a period of time the buffer stack will grow to its maximum allowable length. When this condition is reached, the moving carriage 46 will be in its maximum displacement in the direction of the arrow 49. In this position the microswitch 82 is closed by plate 84 which activates the bulk feed disable solenoid 200 that disables the bulk feed unit and terminates the input of articles into the moving carriage buffer/feeder 10. In this condition the output feeder 142 continues to remove articles from the buffer stack, and when a sufficient number of articles have been removed to reduce the length of the stack below the maximum allowed, the moving carriage 46 and plate 84 travel in the direction of the arrow 49 and the microswitch 82 is opened which deactivates the bulk feed disable solenoid 200 thereby enabling the bulk feeder which resumes supplying articles into the buffer transport 10.

In order to prevent the moving carriage 46 from excessive travel in either direction, microswitches 80 and 86 are provided to disable the motor 50. This circuit is shown in FIG. 7. In some overflow situations, the flow of articles is not terminated immediately upon the disabling of the bulk feeder. If the extra articles continue to be input into the buffer stack, the moving carriage 46 will be caused to overrun its allowable displacement in the direction of arrow 48. To prevent this occurrence, the microswitch 80 is activated to open the power line to the motor 50 and stop the movement of the carriage. Microswitch 86 provides similar protection for travel in the direction of arrow 49. The step structure of plates 84 and 90 provide for activation of the bulk feed disable solenoid 200 and the stop feed solenoid 190 prior to activating microswitches 80 and 86 which disable the motor 50. These two microswitches are safety features which prevent carriage overrun and are not activated in routine operation.

Figure 8:
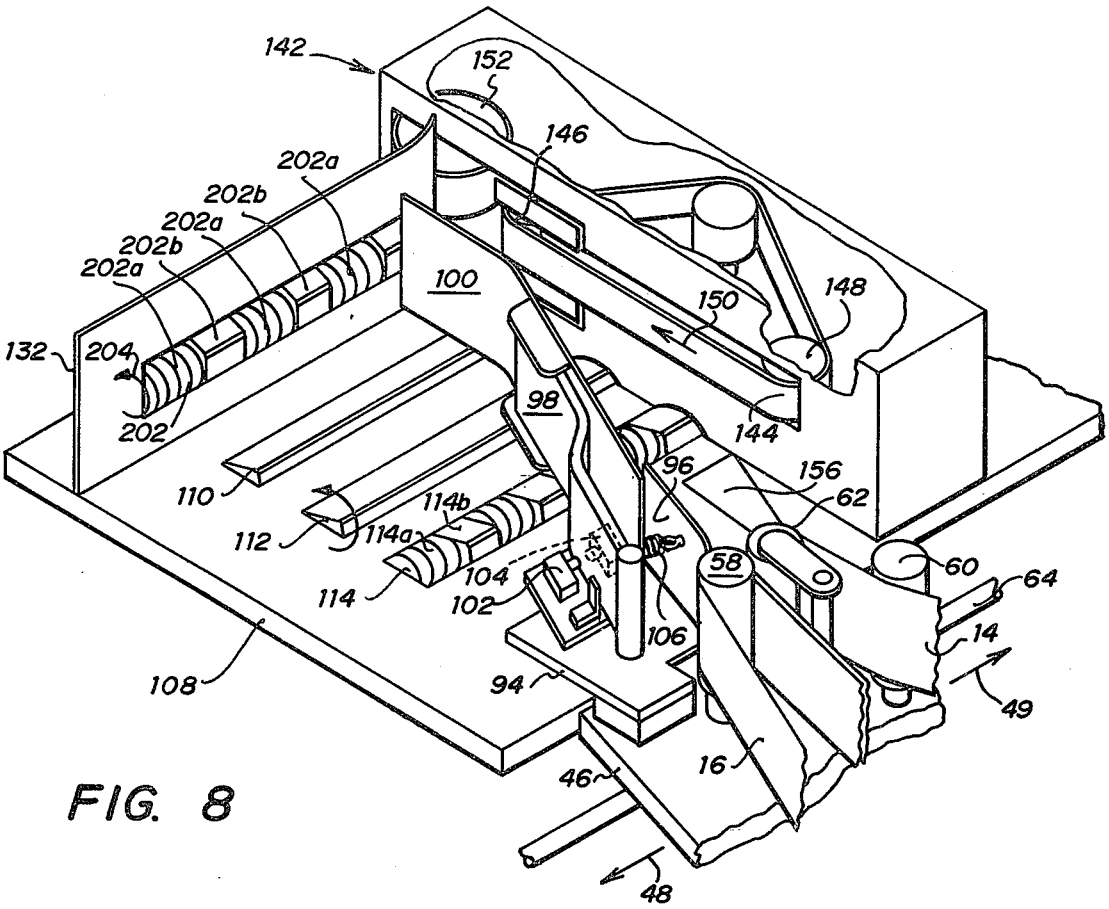
FIG. 8 is a perspective view of an alternate embodiment of the present invention.

An aternative buffer stack advancing and agitating structure is illustrated in FIG. 8. In this embodiment the edging belt 136 shown in FIG. 1 has been replaced by a second segmented beater bar 202 with alternating sections of screw threads 202*a* and flat sides 202*b*. The segmented beater bar 202 rotates in the direction shown by arrow 204. With the addition of this beater bar, the articles in the buffer stack are agitated horizontally as well as vertically. This additional beater bar further aids in edging the mail articles, leveling skewed articles, and urging the buffer stack toward the output feeder 142.

Figure 9:
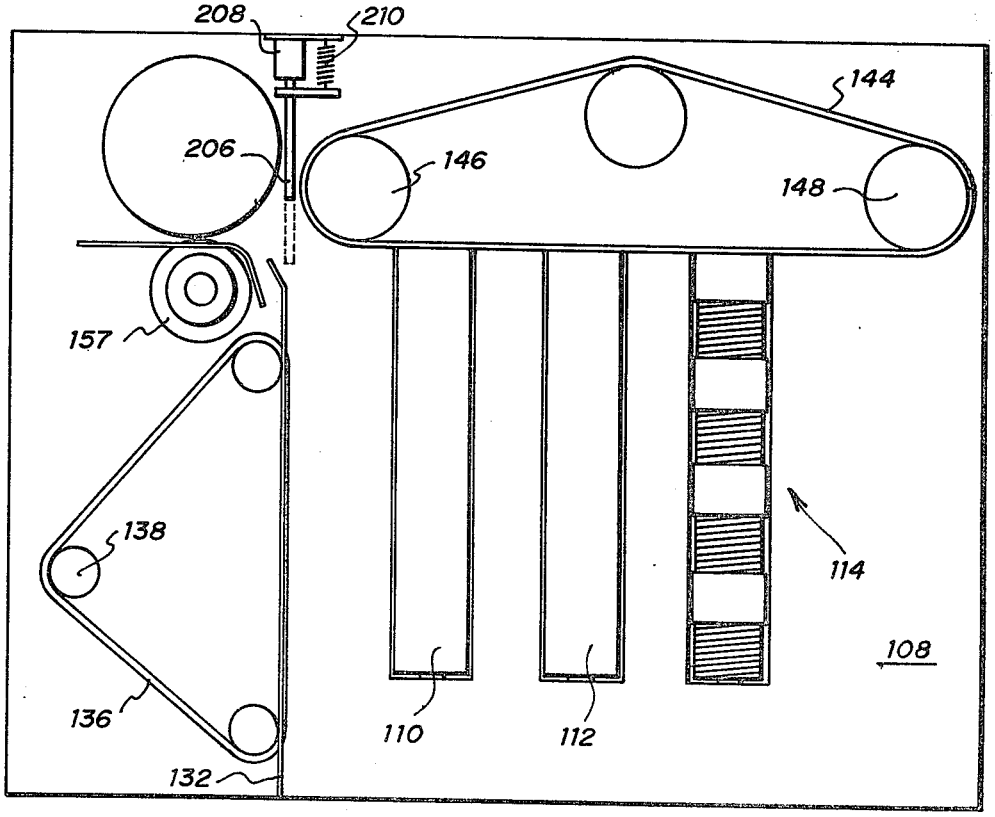
FIG. 9 is a plan view of a still further embodiment of the present invention.

FIG. 9 illustrates an alternative buffer stack stop feed mechanism. In this embodiment the stop feed assembly 154 shown in FIGS. 1 and 6 is replaced by a blocking gate 206 which is disposed essentially in the plane of the edging fence 132. The blocking gate is positioned by a solenoid 208 which when activated advances the blocking gate 206 to block the flow of articles from the feeder belt 144. Deactivation of solenoid 208 causes the blocking gate 206 to retract due to the tension of a spring 210. Electrically, solenoid 208 is substituted for solenoid 190. When the buffer stack reaches its minimum size, the microswitch 88 is activated as described above. With this structure the output of mail articles from the output feeder 142 is stopped by activating solenoid 208 which extends the blocking gate 206. After the buffer stack has grown above the minimum size, the microswitch 88 is deactivated which in turn causes the blocking gate 206 to withdraw and allow the feeder belt 144 to output articles from the buffer stack. This differs operationally from the embodiment shown in FIG. 1 in that the buffer stack is not moved when the output is to be stopped.

Therefore, in accordance with the present invention there is provided a movable carriage buffer/feeder for interfacing a bulk mail feeder to a mail cancelation machine. The buffer/feeder levels skewed mail to prevent jamming and provides a uniform input of articles to the cancelation machine despite variations in the output rate of the bulk feeder.

Although several embodiments of the invention have been illustrated in the accompanying drawing and described in the foregoing detailed description, it will be understood that the invention is not limited to the embodiments disclosed, but is capable of numerous rearrangements, modifications, and substitutions without departing from the scope of the invention.

What is claimed is:

1. A device for transporting and buffering a flow of flat, rectangular articles having a leading edge and a trailing edge opposite the leading edge and a bottom edge extending between the leading and trailing edges, such as letter mail, comprising:

a support frame;

an output feeder positioned on the support frame at the output of a buffer stack for removing articles individually from the stack;

a plurality of parallel rotatable bars supported by said frame with at least one of said bars having screw threaded sections on a cylindrical surface interspaced along its length with polygonal cross sections and at least one of said bars having a polygonal cross section along its length, said bars for supporting and agitating a plurality of the articles collected side by side to form the buffer stack, the articles in the buffer stack transverse to said bars such that the polygonal cross section of the bars engages the bottom edge of the articles to advance the articles in a direction substantially tangential to said bars and said bar with the screw threaded sections thereon further engaging the bottom edge of the articles at a point spaced from the leading edge to move the articles toward said output feeder along the longitudinal axis of the bar;

an edging belt positioned substantially transverse to the movement of the articles by the polygonal cross sections and engaging the leading edge of the articles for advancing the articles in the buffer stack along with the screw threaded sections of said bar toward said output feeder;

a linearly displacable carriage positioned transversely offset from the line-of-travel of the article in the buffer stack and movable parallel to the line of travel;

a conveyor belt assembly having a fixed article input supported by said frame, said conveyor belt assembly extending to and further supported by said carriage for transporting articles from the article input across said carriage in a direction essentially transverse to the line of travel of said carriage;

a pivoting arm supported by said carriage and extending therefrom transverse to the line of travel of the carriage to reach the buffer stack, said pivoting arm including a shoe for directing articles received from said conveyor belt assembly into the buffer stack; and means for displacing said carriage in response to movement of said pivoting arm to maintain essentially a constant pressure on said shoe against the last article in the buffer stack.

2. A transporting and buffering device as recited in claim 1 wherein said means for displacing maintains the entrance angle of articles into the buffer stack within a preselected range.

3. A device for transporting and buffering a flow of flat, rectangular articles having a leading edge and a trailing edge opposite the leading edge and a bottom edge extending between the leading and trailing edges, such as letter mail, comprising:

(a) a supporting frame, (b) at least one rotatable bar supported by said frame and having a noncircular cross section for supporting and advancing in a direction substantially tangential to said bar a plurality of the articles collected side by side in a buffer stack by engaging the bottom edges of the articles, the articles in said buffer stack positioned transverse to said bar, (c) a rotatable edging bar having alternating first and second segments, said first segments having a screw thread configuration and said second segments having a noncircular cross section, said edging bar positioned adjacent the leading edges of the articles in said buffer stack for agitating the articles in the buffer stack and urging the articles therein toward the output feeder, (d) a linearly displaceable carriage positioned transversely offset from the line-of-travel of the articles in said buffer stack and movable parallel to said line-of-travel, (e) a conveyor belt assembly having a fixed article input supported by said frame, said conveyor belt assembly extending to and further supported by said carriage for transporting articles from said article input across said carriage in a direction essentially transverse to the line-of-travel of said carriage, (f) a pivoting arm supported by said carriage and extending therefrom transverse to the line-of-travel of said carriage to reach said buffer stack, said pivoting arm including a shoe for directing articles received from said conveyor belt assembly into said buffer stack, and (g) means for displacing said carriage in response to movement of said pivoting arm to maintain essentially a constant pressure of said shoe against the last article in said buffer stack.

4. A transporting and buffering device as recited in claim 3 further including an additional rotatable bar having alternating first and second segments, said first segments having a screw thread configuration and said second segments having a noncircular cross section, said additional rotatable bar disposed to support and agitate the articles in the buffer stack and urge the articles therein toward said rotatable edging bar and toward the output feeder.

5. A transporting and buffering device as recited in claim 4 wherein said noncircular cross sections are essentially square.

6. A transporting and buffering device as recited in claim 3 wherein said at least one rotatable bar includes a plurality of such bars each having an essentially square cross section, and said bars are synchronized in their rotation such that each bar presents a raised surface to the bottom edge of the articles at the same time.

7. A device for transporting and buffering a flow of flat, rectangular articles having a leading edge and a trailing edge opposite the leading edge and a bottom edge extending between the leading and trailing edges, such as letter mail, comprising:

a support frame;

an output feeder positioned on the support frame at the output of a buffer stack for removing articles individually from the stack;

a plurality of parallel rotatable bars supported by said frame with at least one of said bars having screw threaded sections on a cylindrical surface interspaced along its length with polygonal cross sections and at least one of said bars having a polygonal cross section along its length, said bars for supporting and agitating a plurality of the articles collected side by side to form the buffer stack, the articles in the buffer stack transverse to said bars such that the polygonal cross section of the bars engages the bottom edge of the articles to advance the articles in a direction substantially tangential to said bars and said bar with the screw threaded sections thereon further engaging the bottom edge of the articles at a point spaced from the leading edge to move the articles toward said output feeder along the longitudinal axis of the bar;

an edging belt positioned substantially transverse to the movement of the articles by the polygonal cross sections and engaging the leading edge of the articles for advancing the articles in the buffer stack along with the screw threaded sections of said bar toward said output feeder;

a linearly displacable carriage positioned transversely offset from the line-of-travel of the article in the buffer stack and movable parallel to the line of travel;

a conveyor belt assembly having a fixed article input supported by said frame, said conveyor belt assembly extending to and further supported by said carriage for transporting articles from the article input across said carriage in a direction essentially transverse to the line of travel of said carriage;

a pivoting arm supported by said carriage and extending therefrom transverse to the line of travel of the carriage to reach the buffer stack, said pivoting arm including a shoe for directing articles received from said conveyor belt assembly into the buffer stack;

means for displacing said carriage in response to movement of said pivoting arm to maintain essentially a constant pressure on said shoe against the last article in the buffer stack; and means for terminating the flow of articles from the device when the length of said buffer stack becomes less than a preselected value.

8. A transporting and buffering device as recited in claim 7 wherein said means for terminating comprises:

means for detecting when the length of the buffer stack becomes less than said preselected value, a member having a first position wherein the member contacts the leading article in the buffer stack and displaces the buffer stack from the output feeder and a second position wherein said member is not in contact with the buffer stack, and means responsive to said means for detecting for positioning said member.

9. A transporting and buffering device as recited in claim 7 wherein said means for terminating comprises:

means for detecting when the size of the buffer stack becomes less than the said preselected value, a member having a first position wherein the member blocks the output of the articles from the output feeder and a second position wherein the member is not in contact with the articles, and means responsive to said means for detecting for positioning said member.

10. A transporting and buffering device as recited in claim 7 further including means for terminating the input of articles to the device when the size of said buffer stack exceeds a second preselected value.

* * * * *